US008676109B2

(12) United States Patent
Wakayama

(10) Patent No.: US 8,676,109 B2
(45) Date of Patent: Mar. 18, 2014

(54) CLEANING APPARATUS, AND IMAGE FORMING APPARATUS INCLUDING CLEANING APPARATUS

(75) Inventor: Kei Wakayama, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 60 days.

(21) Appl. No.: 13/352,880

(22) Filed: Jan. 18, 2012

(65) Prior Publication Data

US 2012/0189363 A1 Jul. 26, 2012

(30) Foreign Application Priority Data

Jan. 20, 2011 (JP) ..... 2011-009470

(51) Int. Cl.
*G03G 21/00* (2006.01)

(52) U.S. Cl.
USPC ..... 399/349; 399/350; 399/357

(58) Field of Classification Search
CPC ..... G03G 21/00
USPC ..... 399/345, 349–350, 353, 357, 360
See application file for complete search history.

(56) References Cited

U.S. PATENT DOCUMENTS

| | | | | |
|---|---|---|---|---|
| 4,181,425 | A * | 1/1980 | Higaya et al. | 399/358 |
| 7,817,954 | B2 * | 10/2010 | Yano et al. | 399/349 |
| 8,190,077 | B2 * | 5/2012 | Naruse et al. | 399/349 |
| 8,355,664 | B2 * | 1/2013 | Eiki | 399/349 |
| 2006/0204297 | A1 * | 9/2006 | Honda et al. | 399/349 |
| 2008/0101833 | A1 * | 5/2008 | Morishita | 399/351 |
| 2008/0181690 | A1 * | 7/2008 | Watanabe et al. | 399/350 |
| 2009/0297239 | A1 * | 12/2009 | Aso et al. | 399/350 |
| 2011/0097123 | A1 * | 4/2011 | Eiki | 399/349 |
| 2011/0158722 | A1 * | 6/2011 | Kobayashi et al. | 399/357 |

FOREIGN PATENT DOCUMENTS

| | | | | |
|---|---|---|---|---|
| JP | 11-002996 | | 1/1999 | |
| JP | 1999-002996 | * | 1/1999 | G03G 21/00 |
| JP | 2007-093676 | | 4/2007 | |
| JP | 2007-108269 | | 4/2007 | |
| JP | 2010-091981 | | 4/2010 | |

OTHER PUBLICATIONS

Notice of Reasons for Rejection for Japanese Application No. 2011-009470 mailed May 7, 2013.

* cited by examiner

*Primary Examiner* — Clayton E Laballe
*Assistant Examiner* — Kevin Butler
(74) *Attorney, Agent, or Firm* — Pearl Cohen Zedek Latzer Baratz LLP

(57) ABSTRACT

A cleaning apparatus includes a cleaning blade configured to abut with a surface of the image carrier member, and to remove residual toner from the surface of the image carrier member; a cleaning roller rotatably configured to attach residual toner removed by the cleaning blade to the surface and make abrasive contact with the surface of the image carrier member; a toner layer regulating member configured to regulate residual toner attached to the cleaning roller to a predetermined toner layer thickness and scrape and remove excess residual toner; a frame member configured to store residual toner scraped and removed from the cleaning roller; and a toner supply member configured to make contact with the cleaning roller to attach residual toner stored in the frame member to the surface, and to attach residual toner attached to the surface to the cleaning roller.

7 Claims, 6 Drawing Sheets

CLEANING APPARATUS, AND IMAGE FORMING APPARATUS INCLUDING CLEANING APPARATUS

This application is based on and claims the benefit of priority from Japanese Patent Application No. 2011-009470, filed on 20 Jan. 2011, the content of which is incorporated herein by reference.

BACKGROUND

This disclosure relates to a cleaning apparatus configured to remove residual toner or the like that remains on the surface of an image carrier member, and to an image forming apparatus mounting the cleaning apparatus.

An image forming apparatus using an electrographic method forms an electrostatic latent image on a photosensitive drum by use of an electric charger that applies a charge in advance to an image carrier member, for example, to a photosensitive drum, followed by irradiation of light onto the surface of the photosensitive drum with an exposure unit. Furthermore, a toner image is developed on the surface of the photosensitive drum by attachment of toner stored in a developing unit onto the electrostatic latent image. The image forming apparatus transfers and fixes the visualized toner image onto paper used for direct contact, or onto a sheet of paper via an intermediate transfer member.

Toner transfer onto the sheet may fail and result in residual toner on the surface of the photosensitive drum. Residual toner on the surface of the photosensitive drum must be removed before a subsequent image forming operation.

In this context, a related technique has been disclosed in which the surface of the photosensitive drum is cleaned.

More particularly, an image forming apparatus has been disclosed in which a cleaning blade and a cleaning roller are brought into contact with the surface of the photosensitive drum and the cleaning blade removes residual toner remaining on the surface of the photosensitive drum.

The related techniques include disclosure of a technique in which a tiny amount of abrasive contained in the residual toner is used and the cleaning roller uses the residual toner removed by the cleaning blade to remove a discharge product or the like that is attached to the surface of the photosensitive drum. Furthermore, the related techniques include disclosure of a technique applying in which the thickness of the toner attached to the cleaning roller is adjusted by contact of a scraper to the cleaning roller.

However, the related techniques include the unsolved problem of attaching and maintaining a suitable amount of residual toner to the cleaning roller.

This is due to the fact that adjustment of the toner amount is difficult since the scraper in this technique makes contact with the cleaning roller in a trailing direction and therefore there is a low capacity to peel and remove the residual toner from the cleaning roller.

Furthermore, since the scraper is formed in a film configuration, wear is caused by sliding on the cleaning roller.

On the other hand, a scraper has been proposed that is placed into contact with the cleaning roller in the counter direction. However, in this configuration, residual toner is continuously scraped and removed from the cleaning roller, and therefore residual toner cannot be retained on the cleaning roller.

When continuous printing of a low density printed pattern by the image forming apparatus is assumed, that is to say, during operating conditions in which attachment of the residual toner to the cleaning roller is difficult, provision of either type of scraper may result in failure to maintain the abrasive performance of the cleaning roller that is required to remove a discharge product.

In this manner, optimization of the toner amount attached to the cleaning roller requires a means or mechanism that enables constant maintenance of residual toner attached to the cleaning roller.

SUMMARY

A cleaning apparatus includes a cleaning blade, a cleaning roller, a toner layer regulating member, a frame member, and a toner supply member.

The cleaning blade abuts with a surface of the image carrier member that on which a toner image is formed and from which the toner image is transferred in a transfer unit, and removes residual toner that is toner not transferred by the transfer unit from the surface of the image carrier member.

The cleaning roller is rotatably configured to be pressed into contact with the surface of the image carrier member at a position that is more upstream than the abutment position of the cleaning blade and the surface of the image carrier member with respect to the direction of rotation of the image carrier member, and to attach residual toner removed by the cleaning blade to the surface and make abrasive contact with the surface of the image carrier member by use of the attached residual toner.

The toner layer regulating member is configured to regulate residual toner attached to the cleaning roller to a predetermined toner layer thickness and scrape and remove excess residual toner.

The frame member enables storage of residual toner scraped and removed from the cleaning roller.

The toner supply member makes contact with the cleaning roller at a position that is more upstream than the abutment position of the cleaning roller and the toner layer regulating member with respect to the direction of rotation of the cleaning roller, attaches residual toner stored in the frame member to the surface, and attaches residual toner attached to the surface to the cleaning roller.

An image forming apparatus includes an image carrier member, a transfer unit and a cleaning apparatus.

The image carrier member on a surface of which a toner image is formed.

The transfer unit is configured to transfer the toner image formed on the image carrier member.

The cleaning apparatus has a cleaning blade, a cleaning roller, a toner layer regulating member, a frame member, and a toner supply member.

The cleaning blade is configured to abut with the image carrier member, and remove residual toner, that is toner not transferred by the transfer unit, from the surface of the image carrier member.

The cleaning roller rotatably is configured to be pressed into contact with the surface of the image carrier member at a position that is more upstream than the abutment position of the cleaning blade and the surface of the image carrier member with respect to the direction of rotation of the image carrier member, to attach residual toner removed by the cleaning blade to the surface and to make abrasive contact with the surface of the image carrier member using the attached residual toner.

The toner layer regulating member is configured to regulate residual toner attached to the cleaning roller to a predetermined toner layer thickness and scrape and remove excess residual toner.

The frame member enables storage of residual toner scraped and removed from the cleaning roller.

The toner supply member is configured to make contact with the cleaning roller at a position that is more upstream than the abutment position of the cleaning roller and the toner layer regulating member with respect to the direction of rotation of the cleaning roller, and to attach residual toner stored in the frame member to the surface, and to attach residual toner attached to the surface to the cleaning roller.

DETAILED DESCRIPTION

The preferred embodiments of the present disclosure will be described below making reference to the figures.

Figure 1:
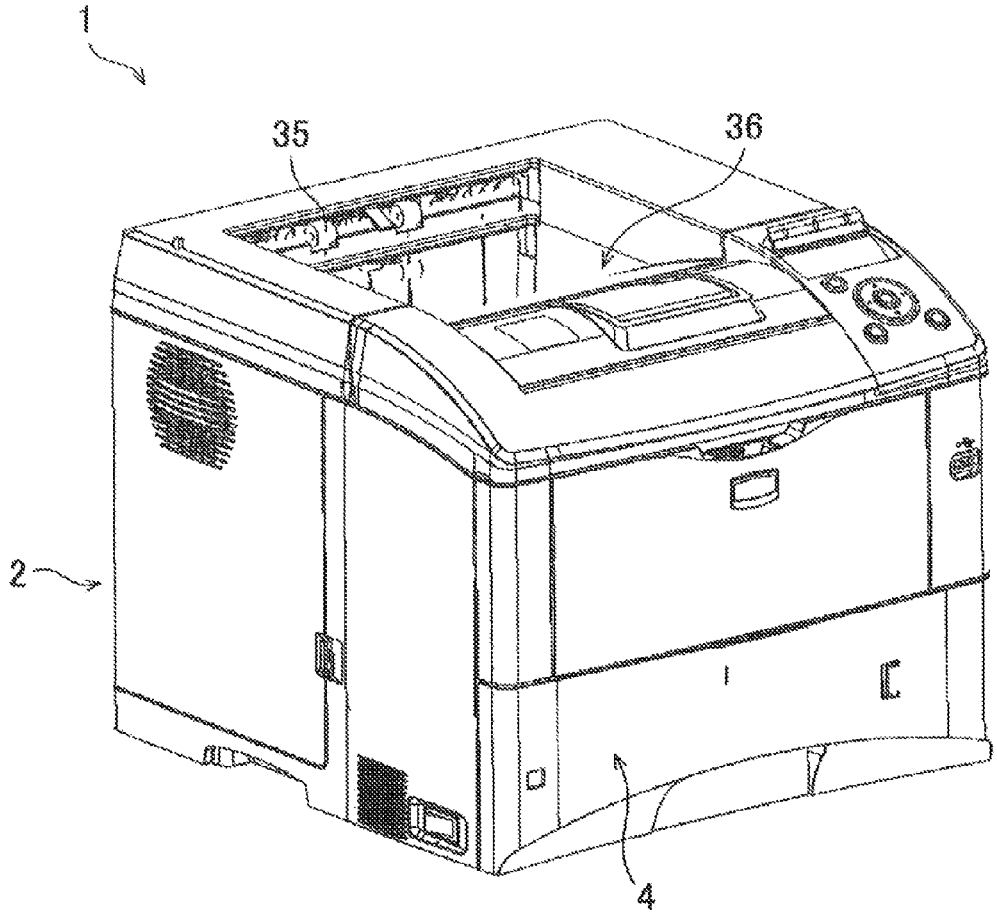
FIG. 1 is an external perspective view of a printer according to the present embodiment.
Figure 2:
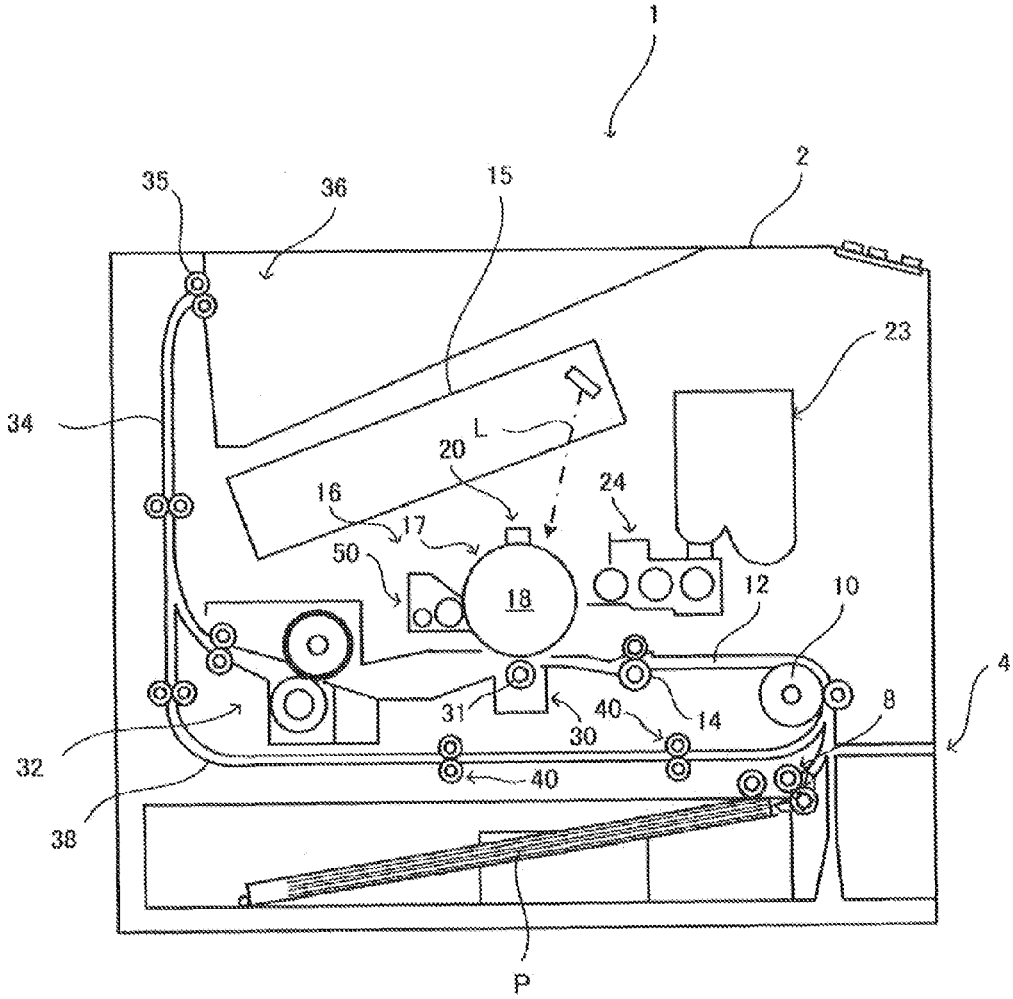
FIG. 2 is a schematic view of the printer in FIG. 1.
Figure 3:
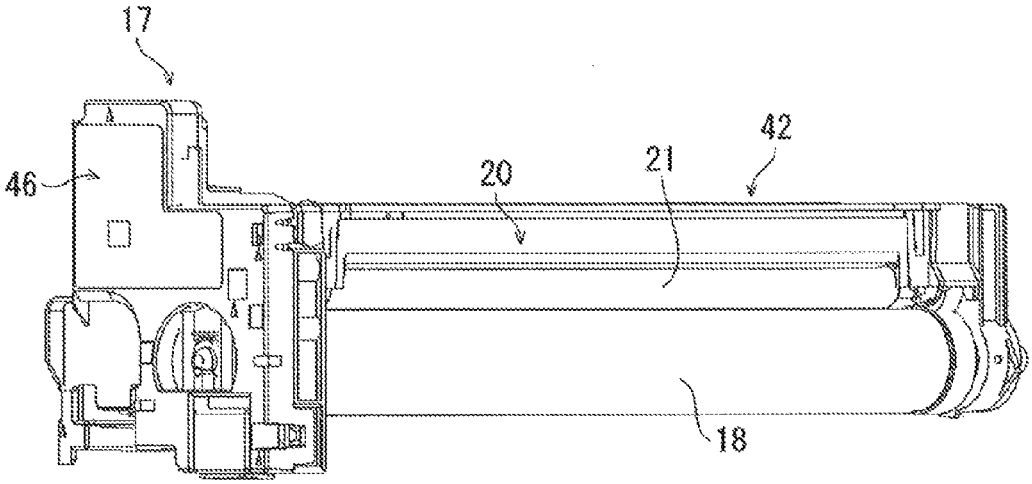
FIG. 3 is a perspective view of the drum unit in FIG. 2.
Figure 4:
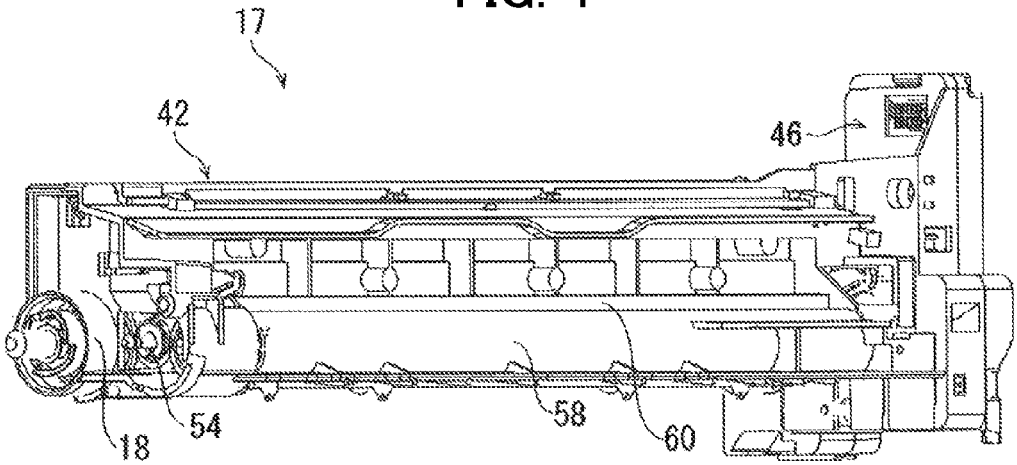
FIG. 4 is a perspective view of the drum unit in FIG. 2.
Figure 5:
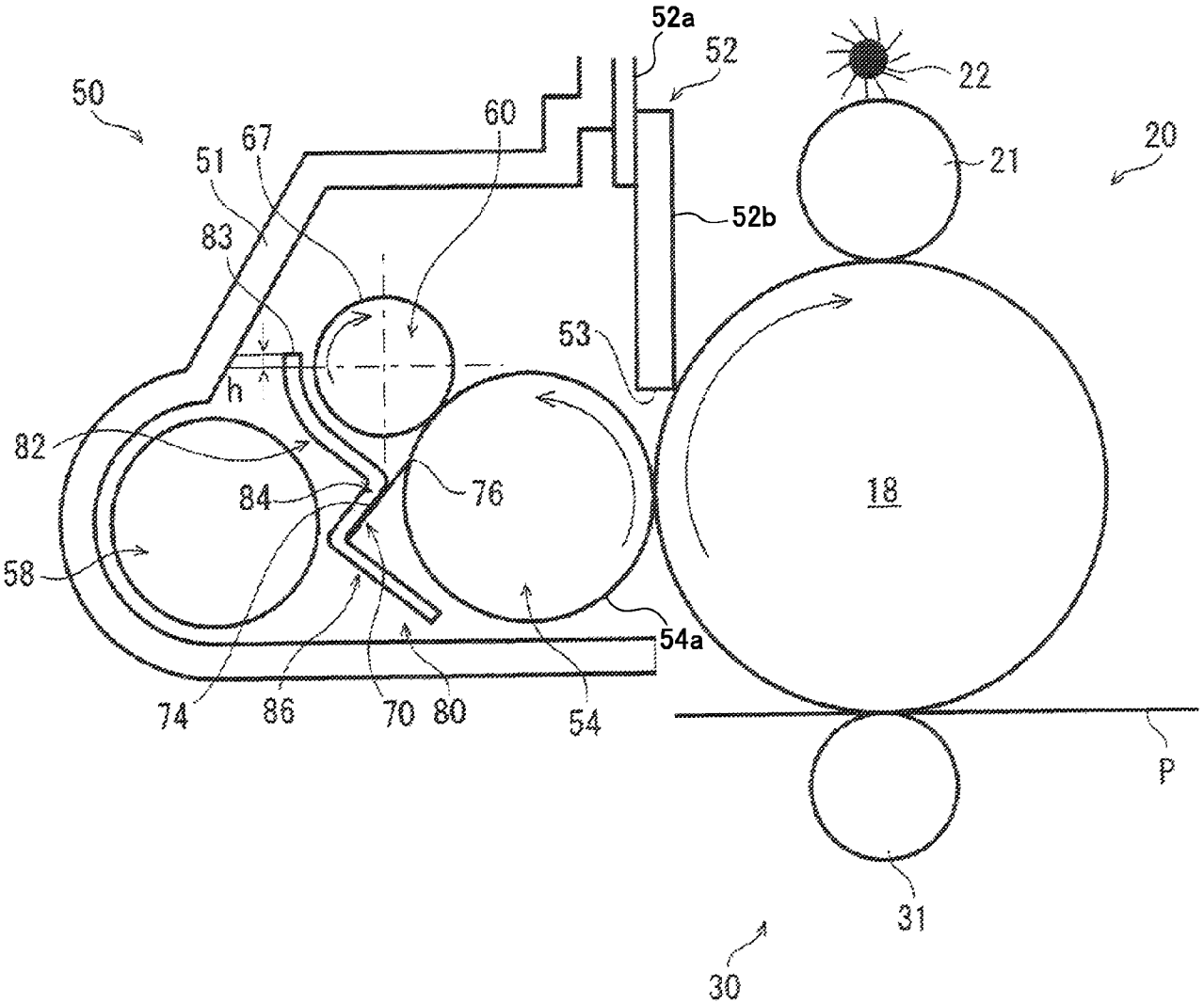
FIG. 5 is an enlarged view of the periphery of the cleaning apparatus in FIG. 2.
Figure 6:
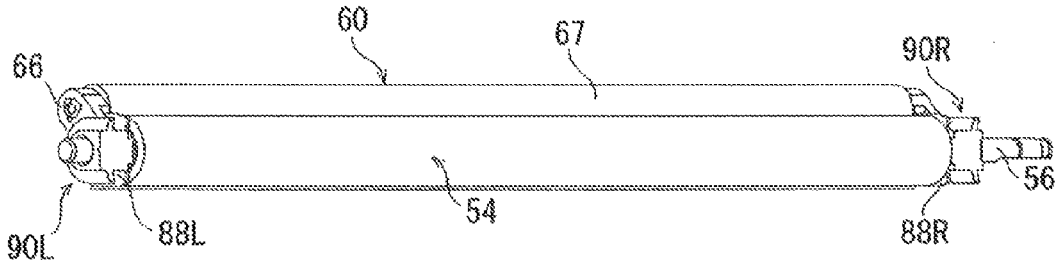
FIG. 6 is a perspective view of the toner supply roller or the cleaning roller in FIG. 5.
Figure 7:
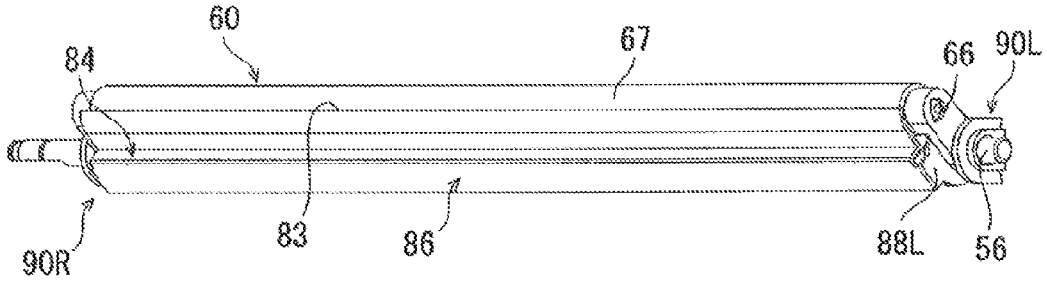
FIG. 7 is a perspective view of the toner supply roller or the cleaning roller in FIG. 5.
Figure 8:
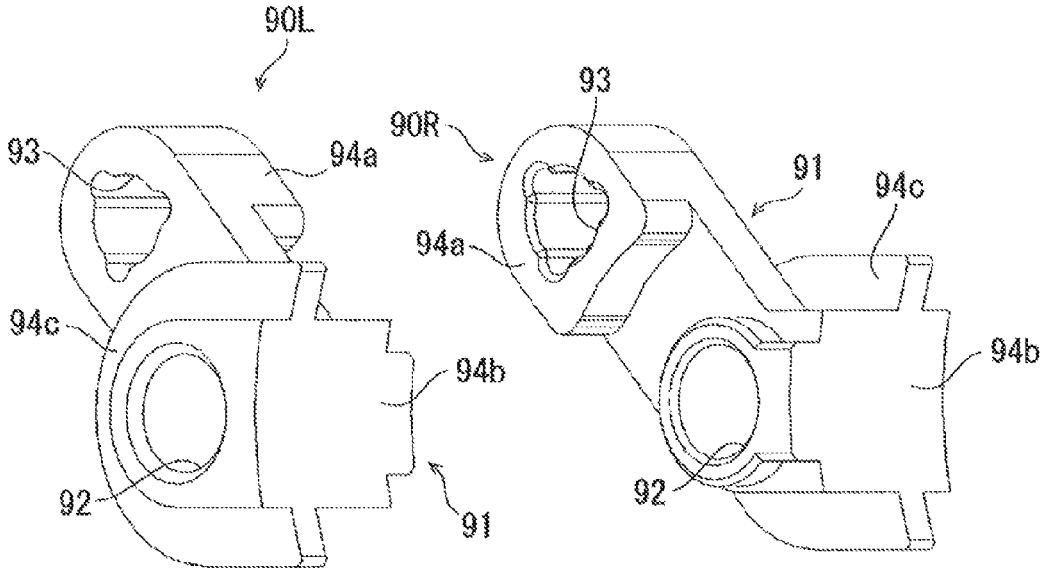
FIG. 8 is a perspective view of an arm member in FIG. 6 and FIG. 7.
Figure 9:
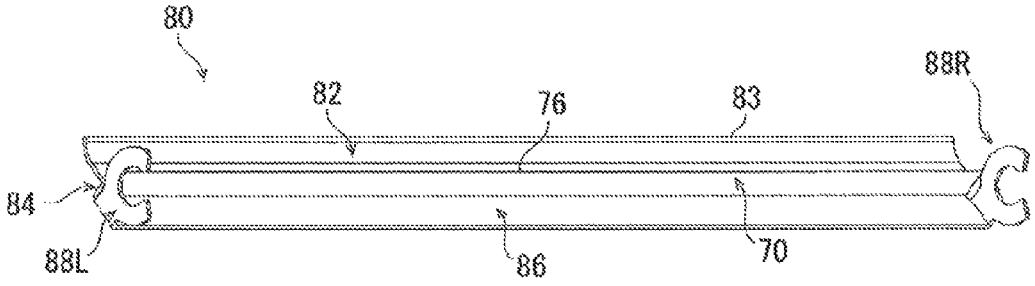
FIG. 9 is a perspective view of the regulating plate holder in FIG. 6 and FIG. 7.

FIG. 1 is an external perspective view of a printer according to the present embodiment. FIG. 2 is a schematic view of the printer in FIG. 1. FIG. 3 is a perspective view of the drum unit in FIG. 2. FIG. 4 is a perspective view of the drum unit in FIG. 2. FIG. 5 is an enlarged view of the periphery of the cleaning apparatus in FIG. 2. FIG. 6 is a perspective view of the toner supply roller or the cleaning roller in FIG. 5. FIG. 7 is a perspective view of the toner supply roller or the cleaning roller in FIG. 5. FIG. 8 is a perspective view of the arm member in FIG. 6 and FIG. 7. FIG. 9 is a perspective view of the regulating plate holder in FIG. 6 and FIG. 7.

FIG. 1 is a view of a printer 1 executing monochrome printing as an example of an image forming apparatus in a left inclined upper view. FIG. 1 illustrates the front surface and left surface of the printer 1. The sectional view illustrated in FIG. 2 is seen from the left side of the printer 1 in FIG. 1. As a result, the front surface of the printer 1 is positioned on the right side of FIG. 2 and the rear surface is positioned on the left side of FIG. 2.

As illustrated in FIG. 1 and FIG. 2, the printer 1 includes an apparatus main body 2. A sheet cassette 4 is disposed in the lower inner portion of the apparatus main body 2. Sheets of paper P are stored in a stacked configuration in an inner portion of the sheet cassette 4. Paper P is conveyed from the sheet cassette 4 toward the upper right direction in FIG. 2, and then is reversed toward the rear surface of the printer 1 in the inner portion of the apparatus main body 2.

The sheet cassette 4 is configured to enable drawing out in the right direction in FIG. 2. The sheet cassette 4 is configured to be pulled out to supply the sheet cassette 4 with new paper P, or replace the paper P with a different type of paper.

When the inner portion of the apparatus main body 2 is viewed from the sheet cassette 4 in the direction of conveyance of the paper, a feed roller 10, a paper conveyance route 12, a regist roller 14, and an image forming unit 16 are disposed in order on the downstream side.

A drum unit 17 that includes a photosensitive drum (image carrier unit) 18 is provided in the image forming unit 16.

More particularly, the drum unit 17 includes an upper housing 42 and a side cover 46 that cover the upper portion and the side portion of the photosensitive drum 18 (FIG. 3 and FIG. 4). The side cover 46 is opposed to the left side surface of the printer 1. The upper housing 42 is connected to the side cover 46, and extends towards the right side surface of the printer 1.

The photosensitive drum 18 is supported to rotate freely on the side cover 46 and the right end of the upper housing 42 disposed on the opposite side to the side cover 46, and is driven in a clockwise direction in FIG. 2 by a drive motor (not shown). The surface of the photosensitive drum 18 according to the present embodiment is an a-Si drum that includes a non-crystalline silicon layer.

As illustrated in FIG. 2, an electric charger 20, an exposure unit 15, a developing unit 24, a transfer unit 30, and a cleaning apparatus 50 are disposed respectively at a predetermined position on the periphery of the photosensitive drum 18.

The electric charger 20 that is disposed above the photosensitive drum 18 is covered by the upper housing 42 (FIG. 3).

More specifically, as illustrated in FIG. 5, the electric charger 20 includes a charging roller 21 making direct contact with the photosensitive drum 18, and a cleaning brush 22 for applying sliding friction to clean the surface of the charging roller 21.

The charging roller 21 and the cleaning brush 22 are both supported to rotate freely on the side cover 46 and the left end portion of the upper housing 42 (FIG. 3). The electric charger 20 applies a uniform charge to the surface of the photosensitive drum 18. The charging roller 21 includes, for example, a surface layer formed from an epichlorohydrin rubber.

As illustrated in FIG. 2, the exposure unit 15 is disposed on an upper side of the drum unit 17. The exposure unit 15 forms an electrostatic latent image on the surface of the photosensitive drum 18 by irradiation of laser light L in response to desired image data onto the photosensitive drum 18.

The developing unit 24 is disposed on the right side of the drum unit 17. The developing unit 24 attaches toner that is supplied from the toner container 23 electrostatically to the surface of the photosensitive drum 18.

The transfer unit 30 is disposed on a lower side of the drum unit 17. The transfer unit 30 includes a transfer roller 31. The transfer roller 31 is configured to enable pressure contact from below with the photosensitive drum 18. The photosensitive drum 18 and the transfer roller 31 form a transfer nip portion for transfer of the toner image to the paper P.

A fixing unit 32, a paper conveyance route 34, and a discharge tray 36 are disposed in order on the downstream side of the transfer unit 30 in the paper conveyance direction.

The paper conveyance route 34 extends upwardly from the downstream side of the fixing unit 32 along the rear surface of the printer 1, and curves towards the front surface of the printer 1 at an upper position of the apparatus main body 2. When printing on only one side of the paper P, the paper P that passes through the fixing unit 32 is discharged into the discharge tray 36 through the discharge roller 35 and is stacked in the hight direction.

In the present embodiment, the paper conveyance route 38 for two-sided printing is formed between the transfer unit 30 and the fixing unit 32, and the paper cassette 4. The paper conveyance route 38 is oriented downwardly by branching from midway on the paper conveyance route 34 at a position along the rear surface of the printer 1, extends in a horizontal direction and curves towards the front surface of the printer 1, is connected with the upstream side of the regist roller 14 for example between the paper feed roller 8 and the feed roller 10, and merges with the paper conveyance route 12. The paper P in the paper conveyance route 38 is conveyed by the conveyance roller 40 towards the paper conveyance route 12.

The cleaning apparatus 50 is disposed on the left of the photosensitive drum 18 as illustrated in FIG. 2.

The cleaning apparatus 50 according to the present embodiment is disposed to face the photosensitive drum 18 at a position that is further downstream of the transfer position with the transfer roller 31 in the rotation direction of the photosensitive drum 18.

The cleaning apparatus 50 includes a lower housing 51 that opens towards the photosensitive drum 18 (FIG. 5).

The cleaning apparatus 50 uses the lower housing 51 to house a cleaning blade 52, a cleaning roller 54 and a toner recovery unit 58 disposed at a predetermined position.

Although omitted from FIG. 3 and FIG. 4, the lower housing 51 is disposed on the inner side of FIG. 3, that is to say, on the front side of the upper housing 42 in FIG. 4. The lower housing 51 is confirmed to be connectable to the upper housing 42 or the side cover 46.

The cleaning apparatus 50 is configured to enable assembly into the drum unit 17 that includes the photosensitive drum 18 and the electric charger 20.

As shown in FIG. 5, the cleaning roller 54 is opposed to the photosensitive drum 18 through the opening of the lower housing 51. The cleaning roller 54 extends along the direction of the rotation axis of the photosensitive drum 18.

The rotation shaft 56 of the cleaning roller 54 is rotatably supported by the lower housing 51 as illustrated in FIG. 6 or FIG. 7. The cleaning roller 54 is driven in an anticlockwise direction with reference to FIG. 5 by a drive motor (not illustrated). In this manner, the cleaning roller 54 rotates in the trailing direction (not the counter direction) with respect to the photosensitive drum 18 and comes into sliding and abrasive contact with the surface of the photosensitive drum 18 after transfer of the toner image.

More specifically, the cleaning roller 54 includes a sliding surface 54*a* (surface) configured from conductive EPDM foam for example. The sliding surface 54*a* is pressed into contact with the surface of the photosensitive drum 18 with a predetermined line velocity ratio. In this manner, the sliding surface 54*a* of the cleaning roller 54 can eliminate discharge products or the like that are attached to the non-crystalline silicon layer of the photosensitive drum 18.

As illustrated in FIG. 5, the cleaning blade 52 includes a main body 52*a* that is fixed to an upper end of the lower housing 51 and a polyurethane blade portion 52*b* for example that is solvent welded to the main body. The cleaning blade 52 includes an edge 53 formed on the lower end of the blade portion 52*b*.

The edge 53 is disposed further on the downstream side than the abutment position of the cleaning roller 54 in the rotation direction of the photosensitive drum 18. The edge 53 extends along the rotation axis of the photosensitive drum 18. The edge 53 is disposed to make line contact with the photosensitive drum 18 in the counter direction. The edge 53 (cleaning blade 52) enables scraping and removal of residual toner and the like that is attached to the surface of the photosensitive drum 18.

The residual toner that is scraped and removed from the surface of the photosensitive drum 18 by the cleaning blade 52 is temporarily stored in proximity to the edge 53 and then is attached to the cleaning roller 54.

In the present embodiment, toner includes a minute amount of abrasive (titanium oxide, silica, alumina, and the like). The cleaning roller 54 makes abrasive contact with the surface of the photosensitive drum 18 by use of toner that includes an abrasive.

In the present embodiment, the cleaning apparatus 50 enables adjustment of the layer thickness of residual toner that is attached to the cleaning roller 54 to a predetermined thickness.

More specifically, the cleaning roller 54 abuts with two members being the toner supply roller (toner supply member) 60 and the toner layer regulating plate (toner layer regulating member) 70.

Firstly, the toner supply roller 60 is disposed on the left upper inclined side of the cleaning roller 54 when viewed in FIG. 5. In other words, the toner supply roller 60 is disposed on the opposite side to the abutment position between the cleaning roller 54 and the photosensitive drum 18, and more upstream than the abutment position of the toner layer regulating plate 70 with the cleaning roller 54 in the rotation direction of the cleaning roller 54.

The toner supply roller 60 makes contact with the cleaning roller 54.

The toner supply roller 60 according to the present embodiment is formed by EPDM that is softer than the cleaning roller 54. The toner supply roller 60 extends along the rotation axis of the photosensitive drum 18 in the same manner as the cleaning blade 52 or the cleaning roller 54 (FIG. 6 or FIG. 7). And the rotation shaft 66 of the toner supply roller 60 is supported to rotate freely on the lower housing 51. The toner supply roller 60 includes a peripheral surface 67 that makes surface contact with the cleaning roller 54.

The toner supply roller 60 is driven to rotate by the rotation of the cleaning roller 54, and rotates in a trailing direction in relation to the rotation direction of the cleaning roller 54, that is to say, rotates in a clockwise direction in response to the counterclockwise rotation of the cleaning roller 54 when viewed in FIG. 5.

The toner supply roller 60 is pressed onto the cleaning roller 54 by a pair of arm members 90L, 90R.

More specifically, the arm member 90L is opposed to the left side surface of the printer 1, the arm member 90R is opposed to the right side surface of the printer 1, and both arms are provided with a resinous arm main body 91 (FIG. 8). Each arm main body 91 includes a connection portion 94*a* respectively connected to both end portions of the cleaning roller 54 and the toner supply roller 60. The connection portions 94*a* respectively extend along a direction that is orthogonal to the respective rotation axes of the cleaning roller 54 and the toner supply roller 60. The arm main body 91 includes respective bulging portions 94*c* on both end positions of the cleaning roller 54. The connection portions 94*a* and the bulging portions 94*c* are respectively connected to the bottom portion 94*b* on the side near the photosensitive drum 18, and the bulging portions 94*c* are disposed more on an outer side than the connection portion 94*a*.

The bearing 93 for the toner supply roller pierces and passes through in proximity to the top of the connection portion 94*a*. The bearings 92 for the cleaning roller pierce and pass through respectively in proximity to the base of the bulging portion 94*c* and the connection portion 94*a*.

The bearing 93 for the toner supply roller rotatably supports the rotation shaft 66 of the toner supply roller 60, and the bearing 92 for the cleaning roller rotatably supports the rotation shaft 56 of the cleaning roller 54.

The pressing amount of the toner supply roller 60 with respect to the cleaning roller 54 is set (adjusted) by the distance between the bearing 92 of the cleaning roller and the bearing 93 of the toner supply roller.

The toner layer regulating plate 70 is configured by a metal plate (for example SUS). The toner layer regulating plate 70 is disposed further downstream than the abutment position of the cleaning roller 54 and the toner supply roller 60 in the rotation direction of the cleaning roller 54. The toner layer regulating plate 70 makes line contact with the cleaning roller 54 in a counter direction (FIG. 5).

More specifically, the edge 76 which is the distal end of the toner layer regulating plate 70 extends along the rotation axis of the cleaning roller 54 in the same manner as the toner supply roller 60. The toner layer regulating plate 70 makes contact with the sliding surface 54*a* of the cleaning roller 54, and scrapes and removes residual toner attached to the cleaning roller 54. More specifically, the toner layer regulating plate 70 scrapes and removes excess toner attached in excess of the predetermined layer thickness that is residual toner attached to the sliding surface 54*a* (surface) of the cleaning roller 54.

The toner layer regulating plate 70 according to the present embodiment is integrally formed in a metal regulating plate holder (frame member) 80 (for example, a zinc galvanized steel plate).

The regulating plate holder 80 is formed to maintain the predetermined strength by formation in a staged configuration as illustrated in FIG. 5. Both the right and left longitudinal ends of the regulating plate holder 80 are fixed to the lower housing 51. The toner layer regulating plate 70 includes a toner storage portion 82, a regulating plate fixing portion 84, a waste toner section partitioning portion 86 formed in order from the top in a vertical direction.

The waste toner section partitioning portion 86 is disposed between the cleaning roller 54 and the toner recovery portion 58 in proximity to the bottom surface of the lower housing 51. The waste toner section partitioning portion 86 is partitioned so that waste toner from the tone recovery portion 58 is not oriented to the opening in the bottom portion of the lower housing 51.

The upper end of the waste toner section partitioning portion 86 is connected to the lower end of the regulating plate fixing portion 84. The waste toner section partitioning portion 86 and the regulating plate fixing portion 84 are connected to thereby bend in a substantially orthogonal direction (FIG. 5, FIG. 7 and FIG. 9).

The edge 76 of the toner layer regulating plate 70 projects from the upper end of the regulating plate fixing portion 84 to the cleaning roller 54. The fixing surface 74 of the toner layer regulating plate 70 is fixed to the surface oriented towards the cleaning roller 54 on the regulating plate fixing portion 84, for example, using a double-side tape, an adhesive, or the like.

The upper end of the regulating plate fixing portion 84 is connected to the lower end of the toner storage portion 82. The regulating plate fixing portion 84 and the toner storage portion 82 are connected to thereby bend in a substantially orthogonal direction (FIG. 5, FIG. 7 and FIG. 9). The toner storage portion 82 stores residual toner that is scraped and removed by the toner layer regulating plate 70 from the cleaning roller 54.

More specifically, the toner storage portion 82 is disposed between the toner supply roller 60 and the toner recovery portion 58. The side on the upper end 83 of the toner storage portion 82 is formed in a substantially arcuate shape along the peripheral surface 67 of the toner supply roller 60 when viewed in cross section. The plate holder (frame member) 80 includes a toner storage portion 82 of which cross-section is in an arcuate shape along the peripheral surface of the toner supply roller 60.

That is to say, the side on the upper end 83 forms a predetermined space with the toner supply roller 60. Moreover, the upper end 83 projects upwardly from the horizontal plane that includes the rotation axis of the toner supply roller 60 (the projection amount h illustrated in FIG. 5).

Engaging arm portions 88L, 88R are provided on the both right and left ends of the waste toner section partitioning portion 86 described above (FIG. 9).

More specifically, the engaging arm portions 88L, 88R according to the present embodiment are formed substantially in the form of a letter "C". The opening portion extends towards the cleaning roller 54, and the inner peripheral portion of the opening portion engages with the outer side of the cleaning roller bearing 92 that is formed on the connection portion 94*a* (FIG. 6 to FIG. 8). In this manner, the regulating plate holder 80 provided with the toner layer regulating plate 70 is fixed to the arm member 90L, 90R.

In this cleaning apparatus 50, when the cleaning roller 54 is driven, the toner supply roller 60 is rotated in response thereto. In the lower housing 51, the supply roller 60 attaches residual toner to the sliding surface 54*a* of the cleaning roller 54 so that the residual toner scraped and removed by the cleaning blade 52 is attached to the peripheral surface 67, and the attached residual toner is pressed onto a resilient surface (sliding surface 54*a*) of the cleaning roller 54.

Then, the edge 76 of the toner layer regulating plate 70 scrapes and removes excess residual toner attached to the sliding surface 54*a* (surface) of the cleaning roller 54 that is in excess of the amount required for abrasive contact with the photosensitive drum 18 in the lower housing 51. The edge 76 of the toner layer regulating plate 70 regulates the layer thickness of the residual toner to a predetermined thickness. The toner layer regulating plate 70 uniformly regulates the layer thickness of the toner attached to the sliding surface 54*a* (surface) of the cleaning roller 54.

The residual toner scraped and removed from the sliding surface 54*a* of the cleaning roller 54 by the toner layer regulating plate 70 is stored in the toner storage portion 82 of the regulating plate holder 80.

Thereafter, when toner scraping and removal continues, residual toner fills in the space between toner supply roller 60 and the toner storage portion 82 and is oriented towards the upper end 83.

The toner filling in the space (storage space) is attached to the peripheral surface 67 of the toner supply roller 60. The attached toner is conveyed towards the opening of the lower housing 51 in response to the rotation of the toner supply roller 60, and is supplied to the abutment position of the toner supply roller 60 and the cleaning roller 54.

The peripheral surface 67 of the toner supply roller 60 also presses residual toner scraped and removed by the toner layer regulating plate 70 onto the resilient surface of the cleaning roller 54, and reattaches the residual toner to the sliding surface 54*a* of the cleaning roller 54.

In contrast, the residual toner overflowing from the upper end of the toner storage portion 82 is recovered by the toner recovery portion 58.

More specifically, the toner recovery portion 58 includes a carrying screw in proximity to the rear surface of the housing 51. The carrying screw is provided on the left side of the cleaning roller 54 as illustrated in FIG. 5, extends along the rotation axis of the photosensitive drum 18, and the distal end of the screw is connected to the drive motor (not illustrated). When the drive motor is driven, residual toner scraped and removed by the toner layer regulating plate 70 in the lower housing 51 is collected in a recovery container (not illustrated) via the carrying screw.

As illustrated in FIG. 2, when the printer 1 mounting the drum unit 17 executes a printing operation, paper P is separated into individual sheets and conveyed from the paper cassette 4 by the paper feed roller 8. The paper P that is conveyed reaches the regist roller 14 via the paper conveyance route 12. The regist roller 14 corrects inclined feed of the paper P and conveys the paper P to the transfer portion 30 at a predetermined paper feed timing in response to the image transfer timing with the toner image formed by the image forming portion 16.

On the other hand, with respect to the photosensitive drum 18, the electric charger 20 charges the surface of the photosensitive drum 18. Next, when laser light L is irradiated in response to image data onto the surface of the photosensitive drum 18 by the exposure unit 15, an electrostatic latent image is formed on the surface of the photosensitive drum 18.

When a developing bias voltage is applied to the developing unit 24, toner from the toner container 23 is attached to the surface of the photosensitive drum 18 by the potential difference with the electrostatic latent image on the surface of the photosensitive drum 18. In this manner, the toner image is formed (visualized) in response to the electrostatic latent image on the surface of the photosensitive drum 18.

When the paper P passes between the photosensitive drum 18 and the transfer roller 31, the toner image formed on the surface of the photosensitive drum 18 is transferred onto the paper P. Thereafter, the toner that remains on the surface of the photosensitive drum 18 is removed by the cleaning apparatus 50.

The paper P that carries an unfixed toner image is conveyed towards the fixing unit 32, and heat and pressure are applied by the heating roller to achieve a predetermined temperature in the fixing unit 32. In this manner, the toner image is fixed. Then, the paper P is conveyed from the fixing unit 32 and discharged to the discharge tray 36.

When executing two-sided printing, the conveyance direction of the paper P that is discharged from the fixing unit 32 switched immediately before discharge to the discharge tray 36. That is to say, the paper P that is printed on one side is returned into the apparatus main body 2, and resent towards the transfer unit 30 through the paper conveyance route 38, and the regist roller 14. In this manner, the toner image is transferred onto the surface of the paper P which has not yet been subjected to printing.

As described above, according to the present embodiment, the cleaning apparatus 50 and the printer 1 that is provided with the cleaning apparatus 50 include a cleaning blade 52 and a cleaning roller 54 that are pressed into contact with the surface of the photosensitive drum 18. The cleaning blade 52 removes residual toner remaining on the surface of the photosensitive drum 18 when the toner image is transferred in the transfer unit to paper or the like. The removed residual toner is attached to the cleaning roller 54. The cleaning roller 54 makes abrasive contact with the surface of the photosensitive drum 18 using the residual toner to thereby remove discharge products and the like attached to the surface of the photosensitive drum 18.

When the thickness of the residual toner that is attached to the cleaning roller 54 fluctuates, preferred abrasive contact with the surface of the photosensitive drum 18 is not possible. This is due to the fact that only those positions with a thick toner layer can be brought into abrasive contact with the surface of the photosensitive drum 18, and therefore positions that have a thin toner layer cannot be brought into abrasive contact with the surface of the photosensitive drum 18. As a result, an adjustment is required in order to prevent fluctuation in the thickness of the residual toner.

In the present embodiment, the cleaning apparatus 50 and the printer 1 that is provided with the cleaning apparatus 50 include the toner supply roller 60, the regulating plate holder 80, and the toner layer regulating plate 70.

More specifically, the toner supply roller 60 makes contact with the cleaning roller 54, and firstly, the peripheral surface 67 removes residual toner in proximity to the abutment position of the surface of the photosensitive drum 18 and the cleaning blade 52, that is to say, the residual toner is removed by the cleaning blade 52, and immediately pressed and attached to the cleaning roller 54. In this manner, the toner supply roller 60 attaches residual toner to the cleaning roller 54, and creates a uniform configuration that eliminates positions that have a low residual toner layer thickness.

Then, the edge 76 of the toner layer regulating plate 70 makes line contact with the cleaning roller 54 in a counter direction, and scrapes and removes residual toner attached to the cleaning roller 54. The toner layer regulating plate 70 can create a uniform configuration by removing those positions with a thick residual toner layer.

Furthermore, the toner supply roller 60 described above presses residual toner onto the cleaning roller 54 to thereby enable reattachment in relation to residual toner in proximity to the abutment position of the surface of the photosensitive drum 18 and the cleaning blade 52 in addition to residual toner that is scraped and removed by the toner layer regulating plate 70 and stored in the regulating plate holder 80.

That is to say, even if it is assumed that the cleaning apparatus 50 and the printer 1 that is provided with the cleaning apparatus 50 adopt a mode of operation in which the residual toner is reduced, the toner amount that is required for abrasive contact with the surface of the photosensitive drum 18 in the cleaning roller 54 can be maintained in a simple manner.

In this manner, the cleaning apparatus 50 and the printer 1 that is provided with the cleaning apparatus 50 according to the present embodiment enable constant maintenance of toner in the cleaning roller 54, that is to say, suitable attachment of the residual toner on the cleaning roller 54 is maintained, and thereby continuous removal of discharge products and the like is enabled.

Therefore, the cleaning apparatus 50 and the printer 1 that is provided with the cleaning apparatus 50 according to the present embodiment enable the surface friction coefficient of the photosensitive drum 18 to be suppressed to a small value. In this manner, the cleaning apparatus 50 and the printer 1 that is provided with the cleaning apparatus 50 reduce the load on the cleaning blade 52. Furthermore, in this manner, the cleaning apparatus 50 and the printer 1 that is provided with the cleaning apparatus 50 according to the present embodiment enable prevention of deflection, high pitched noise, or vibration of the cleaning blade 52.

Furthermore, the cleaning apparatus 50 and the printer 1 that is provided with the cleaning apparatus 50 according to the present embodiment prevent attachment of abrasive to the surface of the photosensitive drum 18. In this manner, the cleaning apparatus 50 and the printer 1 that is provided with the cleaning apparatus 50 according to the present embodiment prevents wear or deterioration of the edge 53 of the cleaning blade 52.

Furthermore, since the cleaning apparatus 50 and the printer 1 that is provided with the cleaning apparatus 50 according to the present embodiment use the toner supply roller 60, residual toner removed by the toner layer regulating plate 70 is displaced along the peripheral surface 67 of the toner supply roller 60, and enable pressing onto the cleaning roller 54 at a position that separated from the toner layer regulating plate 70. Thus, accumulation of residual toner in proximity to the toner layer regulating plate 70 or the regulating plate holder 80 is inhibited for example in comparison to pressing and abutment of the cleaning roller 54 with a plate-shaped member. In this manner, the cleaning apparatus 50 and the printer 1 that is provided with the cleaning apparatus 50 according to the present embodiment prevent an excessive charge due to friction between toner particles.

Furthermore, in the cleaning apparatus 50 and the printer 1 that is provided with the cleaning apparatus 50 according to the present embodiment, the arm members 90L, 90R have the function of a bearing for the cleaning roller 54 and the toner supply roller 60 in addition to the function of regulating the pressing amount of the toner supply roller 60. For this reason, the cleaning apparatus 50 and the printer 1 that is provided with the cleaning apparatus 50 according to the present embodiment are configured to optimize the toner amount on the cleaning roller 54 and also enable a reduction in the number of components.

Furthermore, in the cleaning apparatus 50 and the printer 1 that is provided with the cleaning apparatus 50 according to the present embodiment, the upper end 83 of the toner storage portion 82 is disposed above the rotation axis of the toner supply roller 60. In this manner, the toner storage portion 82 enables mounting of residual toner scraped and removed by the toner layer regulating plate 70 on the peripheral surface 67 of the toner supply roller 60. Therefore, the cleaning apparatus 50 and the printer 1 that is provided with the cleaning apparatus 50 according to the present embodiment facilitate maintenance of the toner amount required for abrasive contact with the surface of the photosensitive drum 18.

Furthermore, in the cleaning apparatus 50 and the printer 1 that is provided with the cleaning apparatus 50 according to the present embodiment, integral formation of the regulating plate holder 80 and the toner layer regulating plate 70 enables provision of a cleaning apparatus 50 in which the number of components can be reduced in comparison to separate formation, and which enables a reduction installation space.

Furthermore, although a photosensitive drum 18 that includes a non-crystalline silicon layer has the advantage of a long product life, provision of the cleaning apparatus 50 enables maintenance of the characteristics of the photosensitive drum 18 for a long period and effective utilization of those advantages.

Since the cleaning apparatus 50 and the printer 1 that is provided with the cleaning apparatus 50 according to the present embodiment avoid attachment of abrasive to the surface of the photosensitive drum 18, contamination of the charge roller 21 of the electric charger 20 due to abrasive remaining on the photosensitive drum 18 and subsequent attachment can be avoided. Moreover, since superior image formation can be executed over a long period of time, the reliability of the printer 1 can be improved.

The present disclosure is not limited to the above embodiments, and various modifications may be applied thereto within a scope that does not depart from the scope of the patent claims.

For example, in the above embodiments, although the peripheral surface 67 of the toner supply roller 60 makes surface contact with the cleaning roller 54, the disclosure is not necessarily limited to that configuration, and the toner supply member in the present disclosure may be formed in a plate shape having a surface portion that makes surface contact with the cleaning roller 54.

As long as the surface of the image carrier body according to the present disclosure is subjected to abrasion with the cleaning roller, the image carrier body can be applied to a photosensitive drum other than an a-Si drum, and in the present embodiment, although an example is described with reference to a printer as an example of an image forming apparatus, the image forming apparatus according to the present disclosure can of course be applied in relation to a multifunctional device, a copying machine, a facsimile or the like.

In any of the above configurations, the effect is obtained that residual toner can be retained and applied in a suitable manner on a cleaning roller in the same manner as described above.

What is claimed is:

1. A cleaning apparatus comprising:

a cleaning blade configured to abut with a surface of an image carrier member on which a toner image is formed and from which the toner image is transferred in a transfer unit, and to remove residual toner, which is not transferred by the transfer unit, from the surface of the image carrier member;

a cleaning roller rotatably configured to be pressed into contact with the surface of the image carrier member at a position that is more upstream than an abutment position of the cleaning blade and the surface of the image carrier member with respect to a direction of rotation of the image carrier member, and to attach residual toner removed by the cleaning blade to a surface of the cleaning roller and make abrasive contact with the surface of the image carrier member by use of the attached residual toner;

a toner layer regulating member configured to regulate the residual toner attached to the surface of the cleaning roller to a predetermined toner layer thickness and scrape and remove excess residual toner;

a frame member configured to store the excess residual toner scraped and removed from the surface of the cleaning roller;

a toner supply member configured to make contact with the surface of the cleaning roller at a position that is more upstream than an abutment position of the surface of the cleaning roller and the toner layer regulating member with respect to a direction of rotation of the cleaning roller, to attach the residual toner stored in the frame member to a surface of the toner supply member, and to attach the residual toner attached to the surface of the toner supply member to the surface of the cleaning roller; and a pair of arm members configured to support both ends of the cleaning roller and the toner supply roller to rotate freely;

wherein the toner supply member is a toner supply roller configured to come into contact with the cleaning roller in a trailing direction relative to the rotation cleaning roller, and wherein each of the pair of arm members includes an arm main body that is configured to regulate a pressing amount of the toner supply roller relative to the cleaning roller.

2. A cleaning apparatus comprising:

a cleaning blade configured to abut with a surface of an image carrier member on which a toner image is formed and from which the toner image is transferred in a transfer unit, and to remove residual toner, which is not transferred by the transfer unit, from the surface of the image carrier member;

a cleaning roller rotatably configured to be pressed into contact with the surface of the image carrier member at a position that is more upstream than an abutment position of the cleaning blade and the surface of the image carrier member with respect to a direction of rotation of the image carrier member, and to attach residual toner removed by the cleaning blade to a surface of the cleaning roller and make abrasive contact with the surface of the image carrier member by use of the attached residual toner;

a toner layer regulating member configured to regulate the residual toner attached to the surface of the cleaning roller to a predetermined toner layer thickness and scrape and remove excess residual toner;

a frame member configured to store the excess residual toner scraped and removed from the surface of the cleaning roller; and a toner supply member configured to make contact with the surface of the cleaning roller at a position that is more upstream than an abutment position of the surface of the cleaning roller and the toner layer regulating member with respect to a direction of rotation of the cleaning roller, to attach the residual toner stored in the frame member to a surface of the toner supply member, and to attach the residual toner attached to the surface of the toner supply member to the surface of the cleaning roller, wherein the toner supply member is a toner supply roller configured to come into contact with the cleaning roller in a trailing direction relative to the rotation cleaning roller, wherein the frame member includes a toner storage portion of which cross-section is in an arcuate shape along a peripheral surface of the toner supply roller, and wherein an upper end of the toner storage portion is positioned to project above a horizontal plane that includes the a rotation axis of the toner supply roller.

3. A cleaning apparatus comprising:

a cleaning blade configured to abut with a surface of an image carrier member on which a toner image is formed and from which the toner image is transferred in a transfer unit, and to remove residual toner, which is not transferred by the transfer unit, from the surface of the image carrier member;

a cleaning roller rotatably configured to be pressed into contact with the surface of the image carrier member at a position that is more upstream than an abutment position of the cleaning blade and the surface of the image carrier member with respect to a direction of rotation of the image carrier member, and to attach residual toner removed by the cleaning blade to a surface of the cleaning roller and make abrasive contact with the surface of the image carrier member by use of the attached residual toner;

a toner layer regulating member configured to regulate the residual toner attached to the surface of the cleaning roller to a predetermined toner layer thickness and scrape and remove excess residual toner;

a frame member configured to store the excess residual toner scraped and removed from the surface of the cleaning roller; and a toner supply member configured to make contact with the surface of the cleaning roller at a position that is more upstream than an abutment position of the surface of the cleaning roller and the toner layer regulating member with respect to a direction of rotation of the cleaning roller, to attach the residual toner stored in the frame member to a surface of the toner supply member, and to attach the residual toner attached to the surface of the toner supply member to the surface of the cleaning roller, wherein the frame member retains the toner amount regulating member.

4. An image forming apparatus comprising: an image carrier member on a surface of which a toner image is formed;

a transfer unit configured to transfer the toner image formed on the image carrier member; and a cleaning apparatus, the cleaning apparatus including:

a cleaning blade configured to abut with a surface of the image carrier member, and to remove residual toner, that is not transferred by the transfer unit, from the surface of the image carrier member;

a cleaning roller rotatably configured to be pressed into contact with the surface of the image carrier member at a position that is more upstream than an abutment position of the cleaning blade and the surface of the image carrier member with respect to a direction of rotation of the image carrier member, to attach residual toner removed by the cleaning blade to a surface of a cleaning roller, and to make abrasive contact with the surface of the image carrier member using the attached residual toner;

a toner layer regulating member configured to regulate the residual toner attached to the surface of the cleaning roller to a predetermined toner layer thickness and scrape and remove excess residual toner;

a frame member configured to store the excess residual toner scraped and removed from the surface of the cleaning roller;

a toner supply member configured to make contact with the surface of the cleaning roller at a position that is more upstream than an abutment position of the surface of the cleaning roller and the toner layer regulating member with respect to a direction of rotation of the cleaning roller, to attach the residual toner stored in the frame member to a surface of the toner supply member, and to attach the residual toner attached to the surface of the toner supply member to the surface of the cleaning roller; and a pair of arm members configured to support both ends of the cleaning roller and the toner supply roller to rotate freely;

wherein the toner supply member is a toner supply roller configured to come into contact with the cleaning roller in a trailing direction relative to the rotation cleaning roller, and wherein each of the pair of arm members includes an arm main body that is configured to regulate a pressing amount of the toner supply roller relative to the cleaning roller.

5. The image forming apparatus according to claim 4, wherein the frame member retains the toner amount regulating member.

6. An image forming apparatus comprising: an image carrier member on a surface of which a toner image is formed;

a transfer unit configured to transfer the toner image formed on the image carrier member; and a cleaning apparatus, the cleaning apparatus including:

a cleaning blade configured to abut with a surface of the image carrier member, and to remove residual toner, that is not transferred by the transfer unit, from the surface of the image carrier member;

a cleaning roller rotatably configured to be pressed into contact with the surface of the image carrier member at a position that is more upstream than an abutment position of the cleaning blade and the surface of the image carrier member with respect to a direction of rotation of the image carrier member, to attach residual toner removed by the cleaning blade to a surface of a cleaning roller, and to make abrasive contact with the surface of the image carrier member using the attached residual toner;

a toner layer regulating member configured to regulate the residual toner attached to the surface of the cleaning roller to a predetermined toner layer thickness and scrape and remove excess residual toner;

a frame member configured to store the excess residual toner scraped and removed from the surface of the cleaning roller; and a toner supply member configured to make contact with the surface of the cleaning roller at a position that is more upstream than an abutment position of the surface of the cleaning roller and the toner layer regulating member with respect to a direction of rotation of the cleaning roller, to attach the residual toner stored in the frame member to a surface of the toner supply member, and to attach the residual toner attached to the surface of the toner supply member to the surface of the cleaning roller, wherein the toner supply member is a toner supply roller configured to come into contact with the cleaning roller in a trailing direction relative to the rotation cleaning roller, wherein the frame member includes a toner storage portion of which cross-section is in an arcuate shape along a peripheral surface of the toner supply roller, and wherein an upper end of the toner storage portion is positioned to project above a horizontal plane that includes a rotation axis of the toner supply roller.

7. The image forming apparatus according to claim 6, wherein the frame member retains the toner amount regulating member.

* * * * *